US011248279B2

(12) United States Patent
Otsuka et al.

(10) Patent No.: US 11,248,279 B2
(45) Date of Patent: Feb. 15, 2022

(54) ALUMINUM-BASED COMPOSITE MATERIAL AND METHOD OF MANUFACTURING THE SAME

(71) Applicant: YAZAKI CORPORATION, Tokyo (JP)

(72) Inventors: Yasufumi Otsuka, Shizuoka (JP); Satoru Yoshinaga, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 935 days.

(21) Appl. No.: 15/343,305

(22) Filed: Nov. 4, 2016

(65) Prior Publication Data

US 2017/0073797 A1 Mar. 16, 2017

Related U.S. Application Data

(63) Continuation of application No. PCT/JP2015/060731, filed on Apr. 6, 2015.

(30) Foreign Application Priority Data

Jun. 2, 2014 (JP) ..... JP2014-114365

(51) Int. Cl.
*C22C 21/00* (2006.01)
*C22C 1/05* (2006.01)
(Continued)

(52) U.S. Cl.
CPC ..... *C22C 21/00* (2013.01); *B22F 3/16* (2013.01); *B22F 7/008* (2013.01); *B22F 9/04* (2013.01);
(Continued)

(58) Field of Classification Search
CPC ..... C22C 1/055; C22C 32/0052; C22C 21/00
See application file for complete search history.

(56) References Cited

U.S. PATENT DOCUMENTS 8,273,290 B2 9/2012 Kondoh et al.
8,833,431 B2 * 9/2014 Xiao ..... C22C 1/026 164/113
(Continued)

FOREIGN PATENT DOCUMENTS

CN 1796589 A 7/2006
CN 102432010 A 5/2012
(Continued)

OTHER PUBLICATIONS

The Japanese office action dated Jun. 12, 2018 in a counterpart Japanese Patent application.
(Continued)

*Primary Examiner* — George Wyszomierski
*Assistant Examiner* — Janell C Morillo
(74) *Attorney, Agent, or Firm* — Metrolex IP Law Group, PLLC

(57) ABSTRACT

An aluminum-based composite material includes an aluminum parent phase, and stick-shaped or needle-shaped dispersive matter of aluminum carbide dispersed in the aluminum parent phase. A method of manufacturing the aluminum-based composite material includes a step of mixing aluminum powder having a purity of 99% by mass or higher with a stick-shaped or needle-shaped carbon material, and pressing and molding a resulting mixture, so as to prepare a compacted powder body. The manufacturing method further includes a step of heating the compacted powder body at 600C to 660C to react the carbon material with aluminum in the aluminum powder, so as to disperse the stick-shaped or needle-shaped dispersive matter of aluminum carbide in the aluminum parent phase.

2 Claims, 4 Drawing Sheets

(51) Int. Cl.

| | |
|---|---|
| ***H01B 1/02*** | (2006.01) |
| ***C22C 32/00*** | (2006.01) |
| ***B22F 3/16*** | (2006.01) |
| ***B22F 7/00*** | (2006.01) |
| ***B22F 9/04*** | (2006.01) |

(52) U.S. Cl.
CPC ..... *C22C 1/055* (2013.01); *C22C 32/0052* (2013.01); *H01B 1/023* (2013.01); *B22F 2009/043* (2013.01); *B22F 2301/052* (2013.01); *B22F 2302/40* (2013.01); *B22F 2999/00* (2013.01)

(56) References Cited

U.S. PATENT DOCUMENTS

| | | | |
|---|---|---|---|
| 9,362,022 | B2 | 6/2016 | Kamiyama et al. |
| 2009/0176090 | A1 | 7/2009 | So et al. |
| 2010/0261028 | A1 | 10/2010 | Kondoh et al. |
| 2012/0118607 | A1 | 5/2012 | Ishibashi et al. |
| 2012/0267141 | A1 | 10/2012 | Kamiyama et al. |
| 2014/0072792 | A1 | 3/2014 | Nakamura et al. |
| 2014/0099231 | A1 | 4/2014 | Ishibashi et al. |

FOREIGN PATENT DOCUMENTS

| | | | |
|---|---|---|---|
| CN | 103502181 | A | 1/2014 |
| JP | H08-260075 | A | 10/1996 |
| JP | 2008-266702 | A | 11/2008 |
| JP | 2009-161849 | A | 7/2009 |
| JP | 4409872 | B2 | 11/2009 |
| JP | 2010-77535 | A | 4/2010 |
| JP | 2010-261088 | A | 11/2010 |
| JP | 2011-171291 | A | 9/2011 |
| WO | 2009/054309 | A1 | 4/2009 |
| WO | 2011/004814 | A1 | 1/2011 |
| WO | 2014/061442 | A1 | 4/2014 |

OTHER PUBLICATIONS

An Official Action dated Jan. 9, 2018 in the counterpart Chinese patent application.
The Chinese office action dated Apr. 24, 2018 in a counterpart Chinese Patent application.
The Japanese office action dated Sep. 4, 2018 in a counterpart Japanese Patent application.
An Official Action dated Aug. 1, 2017 in the counterpart Chinese patent application.
X copy of the German office action issued on Jun. 6, 2018 in a counterpart German Patent application.

* cited by examiner

ALUMINUM-BASED COMPOSITE MATERIAL AND METHOD OF MANUFACTURING THE SAME

CROSS REFERENCE TO RELATED APPLICATION

This application is a Continuation of PCT Application No. PCT/JP2015/1060731, filed on Apr. 6, 2015, and claims the priority of Japanese Patent Application No. 2014-114365, filed on Jun. 2, 2014, the content of all of which is incorporated herein by reference.

BACKGROUND

1. Technical Field

The present invention relates to an aluminum-based composite material and a method of manufacturing the same. More particularly, the present invention relates to an aluminum-based composite material having improved strength while maintaining electrical conductivity, 2. Related Art Copper has been mainly used for conductor materials of electric wires for use in wire harnesses for vehicles. Aluminum is receiving increased attention in view of a reduction in weight of conductors. Copper has high tensile strength and electrical conductivity but has a problem of weight. Aluminum is lightweight but has a problem of insufficient strength. Compounding aluminum and other materials is now being investigated so as to improve both electrical conductivity and strength.

An aluminum alloy-based composite material is disclosed in which carbon nanotubes (CNTs) covered with metal or ceramics are contained in an aluminum alloy matrix, so as to improve strength and electrical conductivity (for example, refer to Patent Literature 1). An element wire is also disclosed that contains an aluminum material and CNTs dispersed in the aluminum material and has a cellulation structure including partition walls containing the CNTs and wall inner portions surrounded by the partition walls and containing the aluminum material and incidental impurities (for example, refer to Patent Literature 2). Further, a composite metal material is disclosed that is produced such that metal powder particles covered with CNTs are sintered with part of surfaces of the particles exposed, wherein diffusion and sintering between the metal powder particles progress at the exposed surfaces (for example, refer to Patent Literature 3).

Patent Literature 1: Japanese Patent No. 4409872

Patent Literature 2: Japanese Unexamined Patent Application Publication No. 2011-171291

Patent Literature 3: International Publication WO 2009/054309

SUMMARY

In Patent Literature 1, the carbon nanotubes are not reacted with a metal parent phase. Patent Literature 1 thus has a problem of a reduction in elongation percentage and electrical conductivity because of bubbles inside aggregations of the carbon nanotubes, and also a problem of an insufficient bond between the carbon nanotubes and the metal parent phase. Further, dispersiveness of the carbon nanotubes derived from the cellulation structure disclosed in Patent Literature 2 is insufficient to improve strength. In Patent. Literature 3, since the metal powder particles which are still in a powder state are reacted with the carbon nanotubes by heat treatment, the carbon nanotubes cannot be highly dispersed, and as a result, the strength may be decreased in the heat-treated powder processed into a desired shape.

Carbide can easily be dispersed in a material including metal such as titanium in which carbon is easily diffused. Carbon is, however, not diffused in aluminum, and it is thus difficult to uniformly disperse nanosized particles of carbide in a material including aluminum.

The present invention has been made in view of the problems in the conventional art. An object of the present invention is to provide an aluminum-based composite material having improved strength while maintaining electrical conductivity, and a method of manufacturing the same.

An aluminum-based composite material according to a first aspect of the present invention includes an aluminum parent phase, and stick-shaped or needle-shaped dispersive matter of aluminum carbide dispersed in the aluminum parent phase.

An aluminum-based composite material according to a second aspect of the present invention is the composite material of the first aspect, wherein the dispersive matter is formed such that a stick-shaped or needle-shaped carbon material is reacted with aluminum in the aluminum parent phase.

An aluminum-based composite material according to a third aspect of the present invention is the composite material of the first or second aspect, wherein the dispersive matter has a ratio of a length to a diameter [length/diameter] in a range of 1 to 30, the length being in a range of 0.01 nm to 1000 nm, the diameter being in a range of 0.01 nm to 200 nm.

A method of manufacturing an aluminum-based composite material according to a fourth aspect of the present invention includes the steps of: mixing aluminum powder having a purity of 99% by mass or higher with a stick-shaped or needle-shaped carbon material, and pressing and molding a resulting mixture, so as to prepare a compacted powder body; and heating the compacted powder body at 600° C. to 660° C. to react the carbon material with aluminum in the aluminum powder, so as to disperse stick-shaped or needle-shaped dispersive matter of aluminum carbide in an aluminum parent phase.

DETAILED DESCRIPTION

Figure 1A:
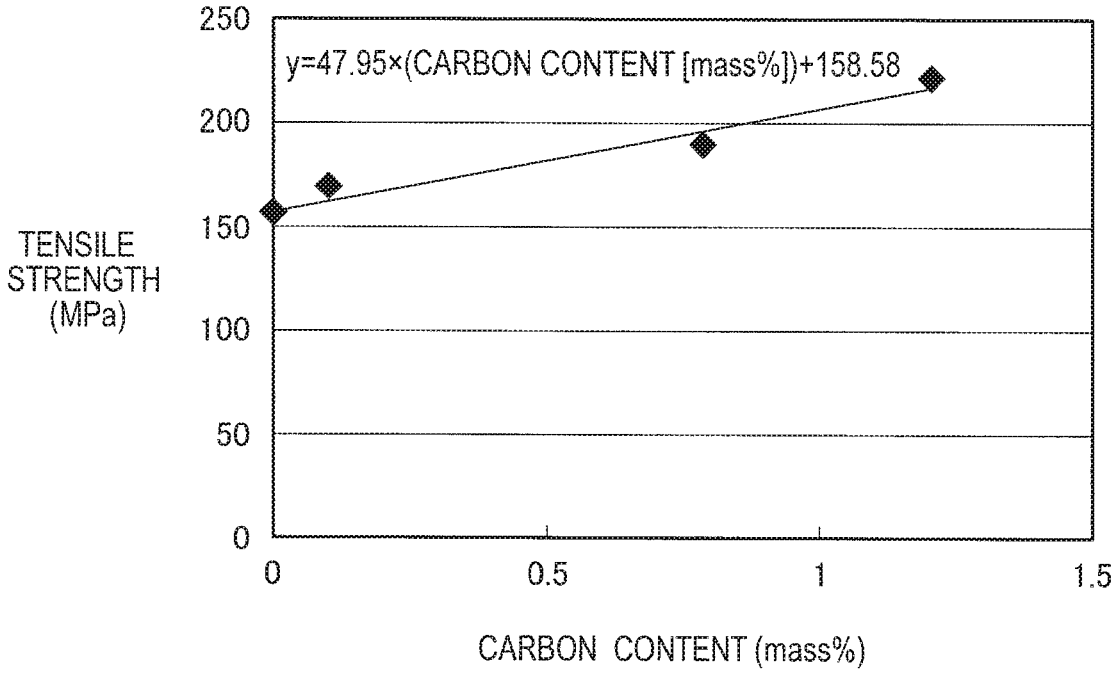
FIG. 1A is a graph showing a relationship between a carbon content and tensile strength in an aluminum-based composite material according to the present embodiment.

Hereinafter; an aluminum-based composite material and a method of manufacturing the same according to an embodiment of the present invention will be described with reference to the drawings.

Aluminum-based Composite Material

The aluminum-based composite material according to the present embodiment includes an aluminum parent phase, and stick-shaped or needle-shaped dispersive matter of aluminum carbide dispersed inside the aluminum parent phase.

A pure aluminum material manufactured by a conventional melting method has tensile strength of only about 70 MPa. Even if carbon is added thereto in order to increase the strength, it is difficult to uniformly disperse carbon in aluminum because carbon has low wettability with respect to aluminum. The aluminum-based composite material according to the present embodiment is manufactured such that a stick-shaped or needle-shaped carbon material is adsorbed to the surface of aluminum powder, and then pressed and sintered at 600° C. or higher, as described below. Accordingly, the stick-shaped or needle-shaped dispersive matter of aluminum carbide is highly dispersed in the aluminum parent phase, so as to micronize aluminum crystal particles. A solidified constitution of aluminum is thus finely equalized, so as to increase the strength and toughness of the composite material.

For the aluminum parent phase according to the present embodiment, aluminum having a purity of 99% by mass or higher is preferably used. Alternatively, among pure aluminum ingots specified in Japanese Industrial Standard JIS H2102 (Aluminum ingots for remelting), an aluminum ingot with purity of Class 1 or higher is also preferably used. Specific examples of aluminum ingots include an aluminum ingot of Class 1 having a purity of 99.7% by mass or higher, an aluminum ingot of Special Class 2 having a purity of 99.85% by mass or higher, and an aluminum ingot of Special Class 1 having a purity of 99.90% by mass or higher. The present embodiment may use not only an expensive aluminum ingot of Special Class 1 or 2 with higher purity but also an inexpensive aluminum ingot having a purity of 99.7% by mass. The use of aluminum of this kind for the aluminum parent phase can increase the electrical conductivity of the resulting aluminum-based composite material. The aluminum parent phase is preferably contained, in the total aluminum-based composite material according to the present embodiment, in an amount of 90% by mass or greater, more preferably 98% by mass or greater.

The aluminum parent phase may contain incidental impurities derived from a raw material thereof or mixed through a production process. Examples of incidental impurities probably contained in the aluminum parent phase include zinc (Zn), nickel (Ni), manganese (Mn), rubidium (Rb), chromium (Cr), titanium (Ti), tin (Sri), vanadium (V), gallium (Ga), boron (B), and sodium (Na). These elements are incidentally contained in amounts that do not preclude the effects of the present embodiment or do not have a particular influence on the properties of the aluminum-based composite material of the present embodiment. Elements preliminarily contained in an aluminum ingot used are included in incidental impurities as used herein. The incidental impurities are contained preferably in an amount of 0.07% by mass or less, more preferably in an amount of 0.05% by mass or less, in the total aluminum-based composite material.

In the aluminum-based composite material according to the present embodiment, the stick-shaped or needle-shaped dispersive matter of aluminum carbide ($Al_4C_3$) is highly dispersed in the aluminum parent phase. This aluminum carbide is obtained such that a stick-shaped or needle-shaped carbon material is sintered, so as to react with aluminum in the aluminum parent phase. The carbon material may be at least one kind selected from the group consisting of carbon nanotubes, carbon nanohoms, and carbon nanofibers. Carbon nanotubes are particularly preferably used as the carbon material.

The carbon nanotubes used may be any conventionally-known substance. A diameter of the carbon nanotubes is, for example, in the range of 0.4 nm to 50 nm, and an average length of the carbon nanotubes is, for example, 1 μm or greater. The carbon nanotubes may be obtained in such a manner as to remove a metal catalyst such as platinum or amorphous carbon by preliminarily washing the carbon nanotubes with acid, or preliminarily subject the carbon nanotubes to high temperature treatment so as to be graphitized. The carbon nanotubes subjected to such pretreatment can be highly purified or crystalized.

In the present embodiment, the stick-shaped or needle-shaped aluminum carbide dispersed in the aluminum parent phase is obtained such that the stick-shaped or needle-shaped carbon material is reacted with aluminum in the aluminum parent phase. The carbon material such as carbon nanotubes is partially or entirely reacted with aluminum in the aluminum parent phase. In the present embodiment, it is particularly desirable that the entire carbon material is reacted with aluminum in the aluminum parent phase, so that the composition is changed into aluminum carbide. If carbon nanotubes are spherically aggregated and remain in the aluminum parent phase, however, part of the carbon nanotubes inside the aggregations is not in contact with the aluminum parent phase. As a result, part of the carbon nanotubes may remain as it is inside the aluminum parent phase. In view of improvement in strength of the aluminum-based composite material, 95% by mass or more, more preferably 98% by mass or more of the carbon material is preferably reacted with aluminum in the aluminum parent phase. It is therefore particularly desirable that the entire carbon material is reacted with aluminum in the aluminum parent phase.

The dispersive matter dispersed in the aluminum parent phase preferably has a stick-like or needle-like shape. The stick-like or needle-like shape can improve the dispersibility of the dispersive matter in the aluminum parent phase and further micronize the crystal particles of aluminum. When the dispersive matter has a stick-like or needle-like shape, a ratio of a length (L) to a diameter (D) (length (L)/diameter (D)) is preferably in the range of 1 to 30. The length (L) is preferably in the range of 0.01 nm to 1000 nm, and the diameter (I)) is preferably in the range of 0.01 nm to 200 nm. The length and diameter of the dispersive matter can be measured such that a cross section of the aluminum-based composite material is observed with a transmission electron microscope.

A gap between adjacent particles in the dispersive matter in the aluminum parent phase is preferably 2 μm or less. The gap of 2 μm or less contributes to increased dispersibility of the dispersive matter in the aluminum parent phase so as to micronize the crystal particles of aluminum. The gap between the adjacent particles in the dispersive matter can also be measured such that a cross section of the aluminum-based composite material is observed with a transmission electron microscope.

Figure 1B:
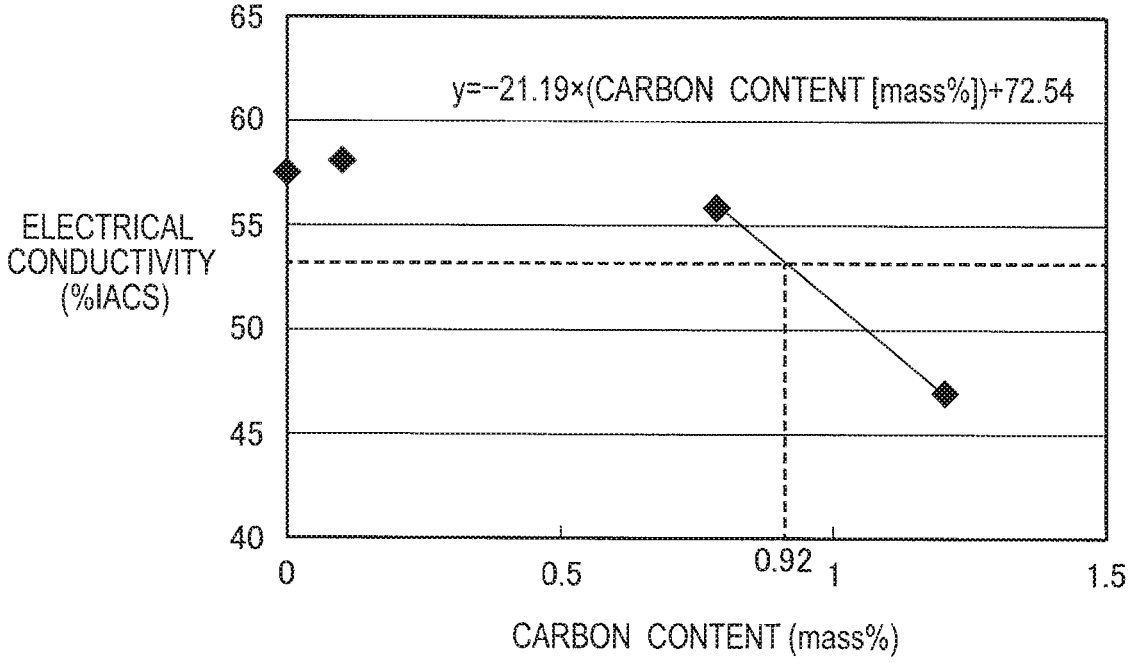
FIG. 1B is a graph showing a relationship between the carbon content and electrical conductivity in the aluminum-based composite material according to the present embodiment.

The amount of the dispersive matter included in the aluminum-based composite material according to the present embodiment is preferably in the range of 0.1% to 2.0% by mass on a carbon basis. The amount of the dispersive matter in this range can ensure desired tensile strength and electrical conductivity when the aluminum-based composite material is used for an electric wire. FIG. 1A shows a relationship between the carbon content of the aluminum-based composite material and the tensile strength of the aluminum-based composite material. FIG. 1B shows a relationship between the carbon content of the aluminum-based composite material and the electrical conductivity of the aluminum-based composite material. As shown in FIG. 1, there is a linear functional correlation between the dispersive matter and the tensile strength and electrical conductivity. As the carbon content of the aluminum-based composite material increases, the tensile strength increases, while the electrical conductivity decreases. When the aluminum-based composite material is used as a material for an electric wire, the electrical conductivity is preferably 30% IACS or greater. The amount of the dispersive matter in the aluminum-based composite material is therefore preferably 2.0% by mass or less on a carbon basis, as shown in FIG. 1B.

In the aluminum-based composite material according to the present embodiment, a crystal particle diameter of the aluminum parent phase is preferably 2 μm or less. The crystal particle diameter of the aluminum parent phase reduced to 2 μm or less can increase the strength and toughness of the aluminum-based composite material. The crystal particle diameter of the aluminum parent phase can be obtained by linear analysis.

The aluminum-based composite material according to the present embodiment preferably has 200 MPa or greater of the tensile strength and 30% IACS or greater of the electrical conductivity. The aluminum-based composite material with such properties can appropriately be used for an electric wire including a conductor with a cross-sectional area of 0.35 $mm^2$. The aluminum-based composite material according to the present embodiment also preferably has 140 MPa or greater of the tensile strength and 53% IACS or greater of the electrical conductivity. The aluminum-based composite material with such properties can appropriately be used for an electric wire including a conductor with a cross-sectional area of 0.5 $mm^2$. The aluminum-based composite material according to the present embodiment further preferably has 94 MPa or greater of the tensile strength and 58% IACS or greater of the electrical conductivity The aluminum-based composite material with such properties can appropriately be used for an electric wire including a conductor with a cross-sectional area of 0.75 $mm^2$ The tensile strength as used herein can be measured in accordance with HS Z2241 (Metallic materials-Tensile testing-Method of test at room temperature). The electrical conductivity as used herein can be measured in accordance with HS H0505 (Measuring methods for electrical resistivity and conductivity of non-ferrous materials).

Since the aluminum-based composite material according to the present embodiment has high electrical conductivity and strength as described above, the aluminum-based composite material can be used for a conductor of an electric wire by being subjected to wiredrawing processing. An electric wire used for the present embodiment is only required to include a conductor (such as a stranded conductor) including a strand made of the aluminum-based composite material, and a cover layer provided on the periphery of the conductor. The other configurations, shape, and manufacturing method for the electric wire are not particularly limited.

The strand included in the conductor is not limited to a particular shape. For example, when a round strand is used for an electric wire for a vehicle, a diameter (final wire diameter) is preferably in the range of about 0.07 mm to 1.5 mm, more preferably about 0.14 mm to 0.5 mm.

A resin used in the cover layer may be any optionally-selected known insulating resin, for example, cross-linked polyethylene, olefin resin such as polypropylene, and vinyl chloride, and a thickness of the cover layer may optionally be determined. The electric wire having the above-described properties may be used for various types of applications such as electric or electronic components, mechanical components, components for vehicles, and construction materials. The electric wire is particularly preferably used for an electric wire for a vehicle.

The electric wire having the conductor including the aluminum-based composite material according to the present embodiment may be joined with an electric wire having a conductor including another metal material by cold solid-state welding. The conductor including the aluminum-based composite material may be equipped with a terminal metal piece attached by crimping in order to facilitate the connection to an electronic device.

The aluminum-based composite material according to the present embodiment includes the aluminum parent phase, and the stick-shaped or needle-shaped dispersive matter of aluminum carbide dispersed inside the aluminum parent phase. Since the nanosized particles of aluminum carbide are highly dispersed in the aluminum parent phase so as to micronize the crystal particles of aluminum, the strength and toughness of the aluminum-based composite material can be increased to substantially the same level as copper. The dispersive matter is obtained such that the stick-shaped or needle-shaped carbon material is reacted with aluminum in the aluminum parent phase. The reaction of the dispersive matter with the parent phase leads to uniformity in material, so as to minimize an elongation of the composite material and a decrease in conductivity.

Method of Manufacturing Aluminum-based Composite Material

Figure 2:
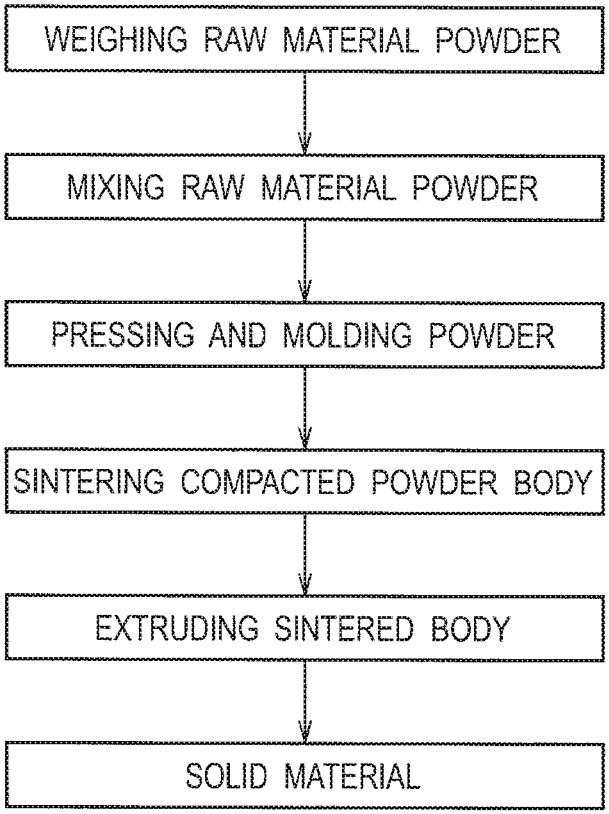
FIG. 2 is a flowchart showing a method of manufacturing the aluminum-based composite material according to the present embodiment.

A method of manufacturing the aluminum-based composite material according to the present embodiment is described below. First, as shown in FIG. 2, aluminum powder and a carbon material as raw materials of the aluminum-based composite material are weighed. The aluminum powder used is preferably aluminum having a purity of 99% by mass or higher so as to increase electrical conductivity The carbon material used is preferably carbon nanotubes, carbon nanohorns, or carbon nanofibers.

In the step of weighing, the aluminum powder and the carbon material are weighed such that the amount of the dispersive matter included in the resulting aluminum-based composite material is preferably in the range of 0.1% to 2.0% by mass on a carbon basis.

The weighed aluminum powder and carbon material are mixed together, so as to prepare mixed powder. The method of mixing the aluminum powder and the carbon material may be either, but not limited to, a dry method by milling or a wet method by mixing with, for example, alcohol.

Next, the mixed aluminum powder and carbon material are pressed and molded to prepare a compacted powder body. In the step of molding, pressure is applied to the mixed powder, so as to prepare the compacted powder body. The step of molding is preferably implemented such that the mixed powder is compacted so that the gap between the aluminum powder and the carbon material in the mixed powder is minimized.

A known method may be used for applying pressure to the mixed powder in the step of preparing the compacted powder body. An example of the method may be a method of placing the mixed powder into a cylindrical molding container and then applying pressure to the mixed powder in the container. The pressure applied to the mixed powder is preferably, but not necessarily, regulated such that the gap between the aluminum powder and the carbon material in the mixed powder is minimized. For example, the pressure applied to the mixed powder may be 600 MPa which can bring the aluminum powder to a preferred molded state. The application of the pressure to the mixed powder in the molding step may be implemented at room temperature. The time for which the pressure is applied to the mixed powder in the molding step may be in the range of 5 to 60 seconds.

Next, the compacted powder body thus obtained is sintered so that the aluminum powder is reacted with the carbon material, so as to produce aluminum carbide in the aluminum parent phase. The step of sintering is implemented such that the sintered temperature of the compacted powder body is set to 600° C. or higher, since the aluminum powder is required to be reacted with the carbon material to produce aluminum carbide. If the sintered temperature of the compacted powder body is lower than 600° C., the aluminum powder is not sufficiently reacted with the carbon material, which may result in insufficient strength of the aluminum-based composite material obtained. The upper limit of the sintered temperature is preferably, but not limited to, lower than or equal to 660° C. which is a melting point of aluminum.

The time for which the compacted powder body is sintered is preferably, but not limited to, a time sufficient to cause a reaction of the aluminum powder with the carbon material. In particular, the time for which the compacted powder body is sintered is preferably in the range of 0.5 to 5 hours, for example. The sintering of the compacted powder body is required to be implemented in an inert atmosphere in order to suppress oxidation of the aluminum powder and the carbon material.

The aluminum-based composite material in which the stick-shaped or needle-shaped dispersive matter of aluminum carbide is dispersed in the aluminum parent phase can be obtained through the sintering step described above. The sintered body obtained in the sintering step is preferably subjected to extrusion processing in order to facilitate the processing of the obtained aluminum-based composite material into a conducting wire. A wire rod as a precursor of the conducting wire thus can be obtained through the extrusion processing of the sintered body.

The method of the extrusion processing of the sintered body may be, but not limited to, a known method. An example of the method may be a method of placing the sintered body into a cylindrical extrusion device and then heating and extruding the sintered body. The heating of the sintered body is preferably implemented at a temperature of 300° C. or higher which is sufficient to extrude the sintered body. An solid material such as a wire rod can be obtained through the extrusion processing. The wire rod thus obtained is repeatedly subjected to, for example, heat treatment and extrusion processing, so as to obtain a conductor for an electric wire.

In the manufacturing method according to the present embodiment, an average particle diameter (D50) of the aluminum powder is preferably 0.25 μm or greater. The aluminum powder having an average particle diameter of less than 0.25 μm may increase the strength of the aluminum-based composite material obtained; however, the amount of oxygen on the surface of the aluminum powder increases, which may decrease electrical conductivity. In other words, the reaction of aluminum with oxygen in air forms a minute oxidized film on the surface and may lead to a decrease in electrical conductivity.

Figure 3A:
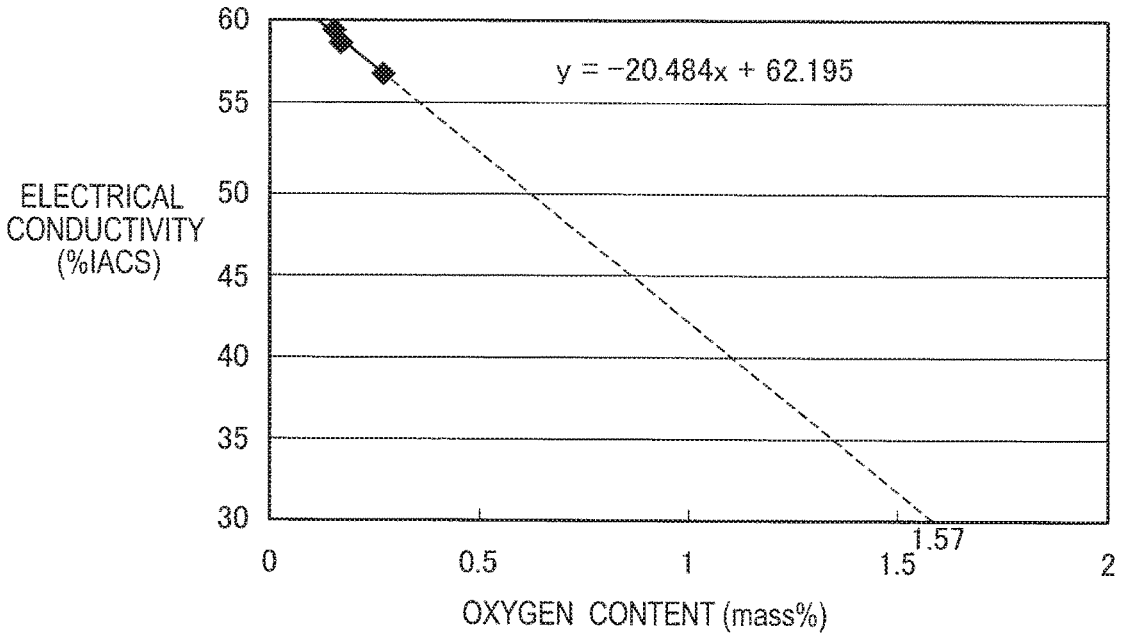
FIG. 3A is a graph showing a relationship between electrical conductivity of aluminum and an oxygen content of aluminum.
Figure 3B:
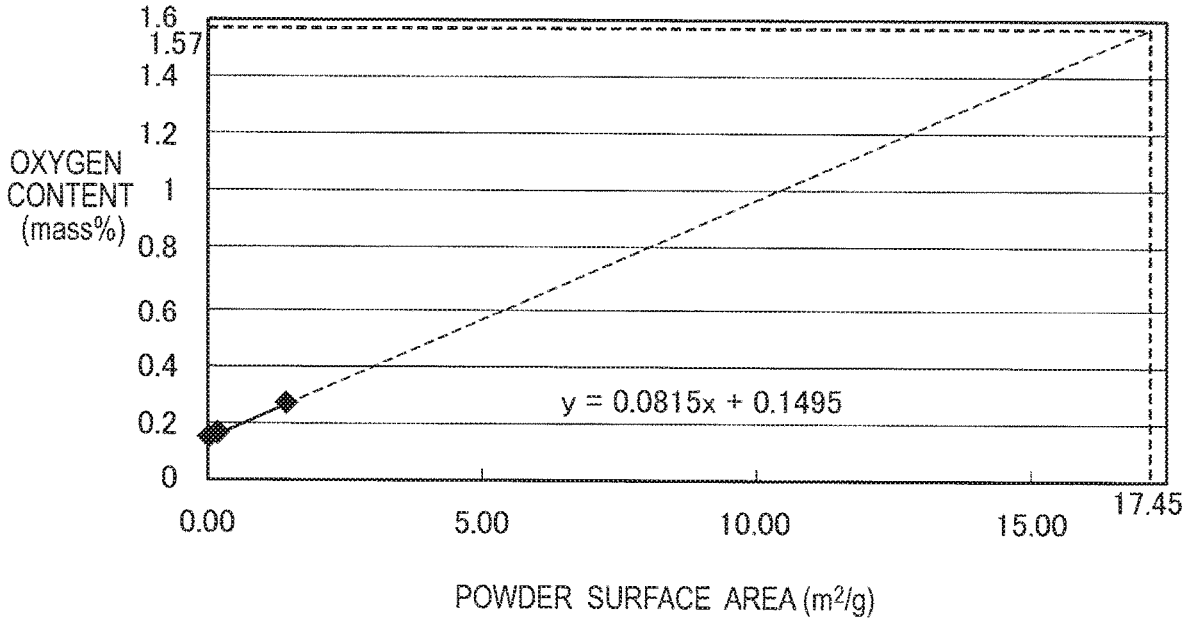
FIG. 3B is a graph showing a relationship between the oxygen content of aluminum and a surface area of aluminum powder.

FIG. 3A shows a relationship between the electrical conductivity of aluminum and the oxygen content of aluminum. FIG. 3B shows a relationship between the oxygen content of aluminum and a surface area of the aluminum powder. As described above, the electrical conductivity is preferably 30% IACS or greater when the aluminum-based composite material is used as a material for an electric wire. As shown in FIG. 3A, the oxygen content of aluminum is preferably 1.57% by mass or less. As shown in FIG. 3B, a specific surface area of the aluminum powder is preferably 17.45 $m^2/g$ or less in order that the oxygen content of aluminum is 1.57% by mass or less. In order to reduce the specific surface area of the aluminum powder to 17.45 $m^2/g$ or less, the average particle diameter (D50) of the aluminum powder is preferably 0.25 μm or greater.

The upper limit of the average particle diameter of the aluminum powder is not limited to a particular value. When the aluminum powder has a substantially spherical shape, however, the average particle diameter of the aluminum powder is preferably 5 μm or less. The average particle diameter exceeding 5 μm decreases the specific surface area of the aluminum powder, which decreases the dispersibility of the carbon material. As a result, the dispersibility of aluminum carbide obtained also decreases, and it may be difficult to micronize the crystal particles of aluminum. The aluminum powder having a substantially spherical shape means that the aluminum powder has an aspect ratio in the range of 1 to 2. As used herein, the aspect ratio is an index denoting a shape of particles defined by a ratio of a maximum longitudinal diameter to a width perpendicular to the maximum longitudinal diameter [maximum longitudinal diameter/width perpendicular to maximum longitudinal diameter] in a microscopic image of particles.

When the aluminum powder has a flat shape, a decrease of thickness of the aluminum powder can increase the surface area, so as to increase the dispersibility of the carbon material on the powder surface. For example, spherical powder having a powder diameter (particle diameter) of 20 μm is processed into a flat shape with a thickness of 1 μm and a longitudinal diameter of 72 μm, so as to have substantially the same surface area as spherical powder having a powder diameter of 3 μm. The upper limit of the average particle diameter of the aluminum powder is therefore not limited to a particular value when the aluminum powder has a flat shape. The aluminum powder having a flat shape means that a ratio of a maximum longitudinal diameter to a thickness in the aluminum powder [maximum longitudinal diameter/thickness] is in the range of 10 to 100. The average particle diameter, the maximum longitudinal diameter, the width perpendicular to the maximum longitudinal diameter; and the thickness of the aluminum powder may be measured by analysis with a scanning electron microscope (SEM).

The method of processing the aluminum powder to have a flat shape may be, but not limited to, a known method. For example, balls having a diameter (φ) of 5 μm to 10 μm, the aluminum powder, and the carbon material are placed into a pot of a planetary ball mill and subjected to rotation processing, so as to obtain the aluminum powder having a flat shape.

The method of manufacturing the aluminum-based composite material according to the present embodiment includes a step of mixing the aluminum powder having a purity of 99% by mass or higher with the stick-shaped or needle-shaped carbon material, and pressing and molding the resulting mixture, so as to prepare the compacted powder body. The manufacturing method further includes a step of heating the compacted powder body at 600° C. to 660° C. to react the carbon material with aluminum in the aluminum powder, so as to disperse the stick-shaped or needle-shaped dispersive matter of aluminum carbide in the aluminum parent phase. In a conventional method by which a structure of a carbon material is kept in an aluminum parent phase, temperature control is complicated. The manufacturing method according to the present embodiment, however, can simplify the manufacturing process without complicated temperature control, since the carbon material is reacted with aluminum in the sintering step.

EXAMPLES

The present invention is described in more detail below with reference to examples and comparative examples, but is not intended to be limited to these examples.

Example 1

First, aluminum powder and carbon nanotubes were weighed such that the content of aluminum carbide in an aluminum-based composite material obtained was 4.00% by mass. The aluminum powder used was ALE16PB (available from Kojundo Chemical Laboratory Co., Ltd.) having a powder diameter of 20 μm. The carbon nanotubes used were FloTube 9000 G2 (available from Cnano Technology Limited).

Next, the weighed aluminum powder and carbon nanotubes were placed into a pot of a planetary ball mill and subjected to rotation processing, so as to prepare mixed powder. The resulting mixed powder was placed into a metal mold and pressed at 600 MPa at room temperature, so as to prepare a compacted powder body.

The compacted powder body thus obtained was heated with an electric furnace at 630° C. for 300 minutes in a vacuum, so as to prepare a sample of this example.

Example 2

Aluminum powder used was ALE11PB (available from Kojundo Chemical Laboratory Co., Ltd.) having a powder diameter of 3 μm. The aluminum powder and carbon nanotubes were weighed such that the content of aluminum carbide in an aluminum-based composite material obtained was 4.84% by mass. The other steps were performed in the same manner as in Example 1, so as to prepare a sample of this example.

Example 3

Aluminum powder and carbon nanotubes were weighed such that the content of aluminum carbide in an aluminum-based composite material obtained was 3.16% by mass. The other steps were performed in the same manner as in Example 2, so as to prepare a sample of this example.

Example 4

Aluminum Mum powder and carbon nanotubes were weighed such that the content of aluminum carbide in an aluminum-based composite material obtained was 0.40% by mass. The other steps were performed in the same manner as in Example 2, so as to prepare a sample of this example.

Example 5

Aluminum powder and carbon nanotubes were weighed such that the content of aluminum carbide in an aluminum-based composite material obtained was 4.00% by mass. When preparing the mixed powder, 2.00% by mass of stearic acid was added as a milling auxiliary agent. The aluminum powder used was ALE16PB (available from Kojundo Chemical Laboratory Co., Ltd.) having a powder diameter of 20 μm. The carbon nanotubes used were Baytubes C 150P (available from Bayer Material Science). The other steps were performed in the same manner as in Example 1, so as to prepare a sample of this example.

Comparative Example 1

The procedure was performed in the same manner as in Example 2 except that carbon nanotubes were not added, so as to prepare a sample of this example.

Comparative Example 2

An aluminum wrought material obtained by a melting method specified in JIS 1060-O was used as a sample of this example.

Evaluation

The yielding stress, tensile strength, and elongation of the respective samples obtained in the Examples and Comparative Examples were measured in accordance with JIS Z2241. In addition, the electrical conductivity of the respective samples was measured in accordance with JIS H0505. Further, the cross section of the respective samples was analyzed with a scanning electron microscope, so as to obtain the crystal particle diameter of the aluminum parent phase by linear analysis. Table 1 shows the yielding stress, tensile strength, elongation, electrical conductivity, and crystal particle diameter of the respective samples of the Examples and Comparative Examples, together with the compositions of the respective samples.

TABLE 1

| | Sample | Yielding Stress (MPa) | Tensile Strength (MPa) | Elongation (%) | Electrical Conductivity (% IACS) | Crystal Particle Diameter (μm) |
|---|---|---|---|---|---|---|
| Example 1 | Al (Powder Diameter 20 μm)/ 4.00 mass % $Al_4C_3$ Composite Material | 153 | 226 | 18.9 | 51.3 | 0.83 |

TABLE 1-continued

| | Sample | Yielding Stress (MPa) | Tensile Strength (MPa) | Elongation (%) | Electrical Conductivity (% IACS) | Crystal Particle Diameter (μm) |
|---|---|---|---|---|---|---|
| Example 2 | Al (Powder Diameter 3 μm)/ 4.84 mass % $Al_4C_3$ Composite Material | 154 | 221 | 21.2 | 46.9 | 0.75 |
| Example 3 | Al (Powder Diameter 3 μm)/ 3.16 mass % $Al_4C_3$ Composite Material | 158 | 189 | 19.9 | 55.8 | 0.80 |
| Example 4 | Al (Powder Diameter 3 μm)/ 0.40 mass % $Al_4C_3$ Composite Material | 140 | 169 | 36.9 | 58.1 | 1.43 |
| Example 5 | Al (Powder Diameter 20 μm)/ 4.00 mass % $Al_4C_3$ Composite Material | 307 | 403 | 7.0 | — | — |
| Comparative Example 1 | Pure Al Material by Powder Metallurgy (Powder Diameter 3 μm) | 135 | 156 | 37.4 | 56.7 | 1.28 |
| Comparative Example 2 | Aluminum Wrought Material by Melting Method (JIS1060-O) | 30 | 70 | 43.0 | 62.0 | 30 to 100 |

The results in Table 1 show that the tensile strength was improved in Examples 1 to 5 according to the present invention as compared with Comparative Examples 1 and 2. As is apparent from the comparison between Examples 1 and 2 and Comparative Example 1, the increase of content of aluminum carbide decreases the electrical conductivity but significantly improves the tensile strength. As is apparent from the comparison between Examples 3 and 4 and Comparative Example 1, an appropriate adjustment of the content of aluminum carbide can improve the tensile strength, while maintaining the electrical conductivity.

In the Examples, the use of the planetary ball mill in the step of mixing the aluminum powder and the carbon nanotubes could bring the aluminum powder into a flat shape.

Figure 4:
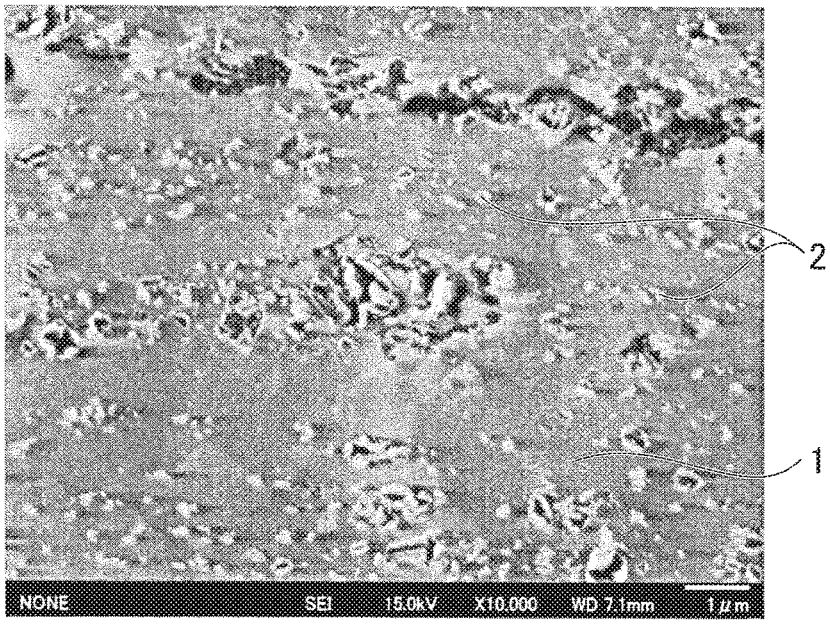
FIG. 4 is a scanning electron microscope showing a cross section of an aluminum-based composite material of Example 1.

FIG. 4 shows an image when observing the cross section of the sample of Example 1 with a scanning electron microscope. As shown in FIG. 4, the observation result indicates that the aluminum-based composite material of Example 1 includes particles of aluminum carbide 2 that are highly dispersed in the aluminum parent phase 1.

Figure 5:
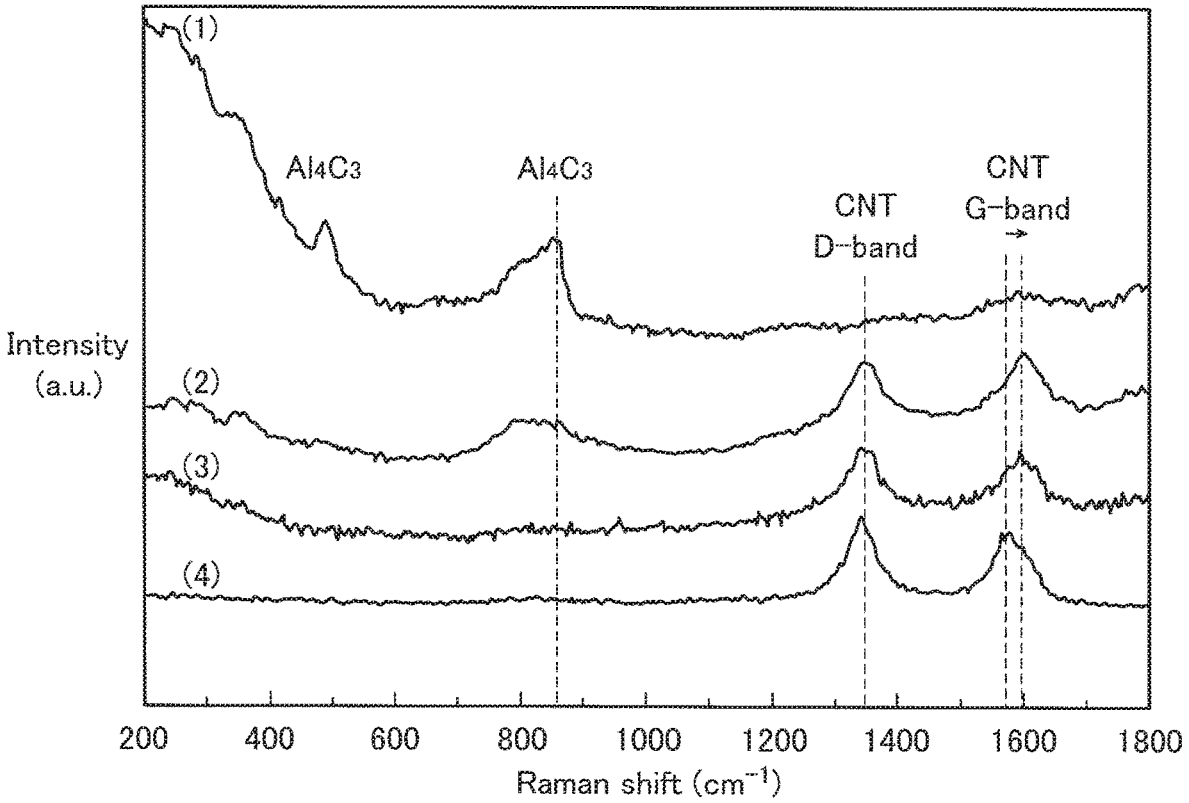
FIG. 5 is a graph showing results of Raman spectroscopy in the aluminum-based composite material of Example 1.

FIG. 5 shows results of Raman spectroscopic analysis of the aluminum-based composite material of Example 1. Item (1) in FIG. 5 is a spectrum of the aluminum-based composite material of Example 1, and item (2) is a spectrum of the aluminum-based composite material in which part of the carbon material is not reacted with aluminum. Item (3) in FIG. 5 is a spectrum of the compacted powder body of the aluminum powder and the carbon nanotubes (CNTs) in Example 1, and item (4) is a spectrum of the carbon nanotubes themselves. As shown in FIG. 5, the aluminum-based composite material of Example 1 has a peak with regard to aluminum carbide ($Al_4C_3$) but no D or G band peak of the carbon nanotubes. The spectra (2) to (4), however, each show D and G band peaks of the carbon nanotubes. The analysis of the aluminum-based composite material of Example 1. indicates that the carbon nanotubes as the carbon material were reacted with the aluminum to be changed into aluminum carbide.

The aluminum-based composite material according to the present invention is obtained such that the stick-shaped or needle-shaped dispersive matter of aluminum carbide is highly dispersed in the aluminum parent phase, so as to micronize crystal particles of aluminum. As a result, the strength and toughness of the aluminum-based composite material can be increased as high as copper. Further, the reaction of the dispersive matter with the parent phase leads to uniformity in material, so as to minimize an elongation of the composite material and a decrease in electrical conductivity.

While the present invention has been described above by reference to the examples, the present invention is not intended to be limited to the descriptions thereof, and various modifications will be apparent to those skilled in the art within the scope of the present invention.

What is claimed is:

1. An aluminum-based composite material comprising:

an aluminum parent phase; and stick-shaped or needle-shaped dispersive matter of aluminum carbide dispersed in the aluminum parent phase, wherein the dispersive matter dispersed in the aluminum parent phase is set to have a ratio of a length to a diameter in a range of 1 to 30, the length being in a range of 0.01 nm to 1000 nm, the diameter being in a range of 0.01 nm to 200 nm so as to maintain electrical conductivity, wherein the dispersive matter is formed such that a stick-shaped or needle-shaped carbon material is reacted with aluminum in the aluminum parent phase by sintering to achieve the dispersion of the dispersive matter, wherein an amount of the dispersive matter is in a range of 0.1% to 2.0% by mass of carbon content, and wherein the carbon material consists of at least one kind selected from the group consisting of carbon nanotubes, carbon nanohorns, and carbon nanofibers.

2. An electric conductor comprising:

the aluminum-based composite material according to claim 1.

* * * * *